US008087458B2

(12) United States Patent
Birner

(10) Patent No.: US 8,087,458 B2
(45) Date of Patent: Jan. 3, 2012

(54) REMOVABLE HYDRAULIC-SET PACKER

(75) Inventor: Wolfgang Birner, Winsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 196 days.

(21) Appl. No.: 12/555,026

(22) Filed: Sep. 8, 2009

(65) Prior Publication Data

US 2011/0056676 A1 Mar. 10, 2011

(51) Int. Cl.
*E21B 33/128* (2006.01)
*E21B 33/1295* (2006.01)

(52) U.S. Cl. ..... 166/120; 166/387

(58) Field of Classification Search ..... 166/179, 166/118, 120, 387
See application file for complete search history.

(56) References Cited

U.S. PATENT DOCUMENTS

| | | | |
|---|---|---|---|
| 3,122,205 | A | 2/1964 | Brown et al. |
| 3,586,106 | A | 6/1971 | Conrad |
| 3,659,647 | A | 5/1972 | Brown |
| 4,437,516 | A | 3/1984 | Cockrell |
| 4,754,814 | A | 7/1988 | Jordan, Jr. |
| 5,810,082 | A | 9/1998 | Jordan, Jr. |
| 5,819,854 | A | 10/1998 | Doane et al. |
| 5,893,413 | A | 4/1999 | Lembcke et al. |
| 6,119,774 | A | 9/2000 | Doane et al. |
| 6,648,335 | B1 | 11/2003 | Ezell |
| 7,225,867 | B2 | 6/2007 | Mackenzie et al. |
| 2002/0088616 | A1* | 7/2002 | Swor et al. ..... 166/118 |
| 2007/0246227 | A1* | 10/2007 | Ezell et al. ..... 166/387 |
| 2010/0012330 | A1* | 1/2010 | Ezell et al. ..... 166/387 |

FOREIGN PATENT DOCUMENTS

CA 2444588 9/1997

OTHER PUBLICATIONS

Weatherford, "Packer Systems," Brochure, copyright 2005.
Patton, L. Douglas, Petroleum Engineering Handbook, "Chapter 4: Production Packers," 1992.
Search Report from Application No. GB1011984.0, dated Sep. 20, 2010.

* cited by examiner

*Primary Examiner* — Daniel P Stephenson
(74) *Attorney, Agent, or Firm* — Wong, Cabello, Lutsch, Rutherford & Brucculeri, LLP

(57) ABSTRACT

A removable hydraulic set packer has a piston activated by fluid in the bore of the packer's mandrel. The piston disengages from the mandrel and pushes a lower wedge unit towards an upper wedge unit. The wedge units push a slip outward from the mandrel toward the surrounding casing. The packer uses a delay between the setting of the slip and the compression of a packing element. In this way, the piston's movement does not compress the packing element until the slip has been able to fully engage the casing. Once the slip is set, the piston assembly can then move a lower gage ring and compresses the packing element against a fixed gage ring fixed. The delay can use a temporary connection between the piston and the lower wedge unit and can use a shoulder distanced from the lower gage ring. Alternatively, a secondary piston with dogs can provide the delay.

32 Claims, 8 Drawing Sheets

REMOVABLE HYDRAULIC-SET PACKER

BACKGROUND

Particular configurations have been used for hydraulic-set packers in the art to avoid movement of the mandrel during operation. For example, looking from the uphole end to the downhole end, one typical configuration for a prior art hydraulic-set packer has a packing element at the uphole end, slips at the downhole end, and a hydraulic piston disposed between them on the packer. Another typical configuration for a prior art hydraulic-set packer has slips at the uphole end, a hydraulic piston at the downhole end, and a packing element disposed between them on the packer. Any configuration for a hydraulic-set packer other than these typical configurations will have issues with mandrel movement during setting procedures, which is undesirable when operating the packer.

In addition, some retrievable packers in the art have an element mandrel for the packing element that slides on the packer's main mandrel. The element mandrel seals with an O-ring on the main mandrel. Unfortunately, this arrangement can be unacceptable for high performance packers because the packer can be prone to leaking.

The subject matter of the present disclosure is directed to overcoming, or at least reducing the effects of, one or more of the problems set forth above.

SUMMARY

A removable hydraulic-set packer has a packing element, a slip assembly, and a piston assembly disposed on a mandrel. In contrast to the typical configuration, the packer has the packing element at the uphole end, the piston assembly at the downhole end, and the slip assembly disposed between them on the mandrel. Fluid in the mandrel's internal bore activates the piston assembly by moving a piston housing of the assembly after breaking a temporary connection by shear pins. Moved by the pressure, the piston housing pushes a lower wedge unit towards an upper wedge unit disposed on the mandrel. As the lower wedge unit moves towards the upper wedge unit, a slip member of the slip assembly disposed between these wedge units then pushes outward from the mandrel toward the surrounding casing.

Before any compression of the packing element occurs, however, the packer delays the compression of the packing element until after the slip assembly has been set. In this way, the piston's movement does not compress the packing element until the piston's movement has first moved the slip member to engage the surrounding casing. Once the slip member is set, then the piston assembly moves a lower gage ring toward an upper gage ring fixed on the mandrel to compress the packing element.

In one arrangement, a temporary connection, such as a shear pin, between the piston housing and the lower wedge unit acts to delay the compression of the packing element until after the setting of the slip member. In addition, a shoulder separated from the lower gage ring and movable by the piston housing also acts to delay the compression of the packing element.

In operation, for example, the piston housing moves the lower wedge unit towards the upper wedge unit to push the slip member outward to the surrounding casing as discussed before. However, the build-up of pressure against the piston housing is applied to setting the slip member until a particular extent in the delay is reached. In particular, the pressure build-up sets the slip member until the temporary connection between the piston housing and the lower wedge unit breaks and/or until the shoulder of the piston housing engages the lower gage ring. The break of the temporary connection may be designed to occur before, during, or slightly after the point when the shoulder of the piston housing engages the lower gage ring. Either way, the build-up of pressure against the piston housing once the slip sets is then applied to compressing the packing element.

In another arrangement, the piston assembly has primary and secondary pistons that act to delay the compression of the packing element until after the setting of the slip assembly. The secondary piston fits between the primary piston and the mandrel and has collapsible dogs that temporarily couple the primary piston to the mandrel. Pressure in the internal bore acts against the secondary piston and moves it in a first direction (toward the packer's uphole end). Affixed to this secondary piston, the lower wedge unit of the slip assembly also moves in the first direction and sets the slip member. However, the dogs disposed on the secondary piston each has one end positioned in an inside slot of the primary piston and has another end positioned in an outer slot of the mandrel. In this way, the dogs hold the primary piston stationary relative to the mandrel even though fluid pressure from the mandrel's bore may act against the primary piston.

As the secondary piston moves, the stationary dogs pass along channels formed in the secondary piston. As they travel, the dogs keep the primary piston fixed relative to the mandrel until the dogs reach a recessed portion of the channel. Reaching the recess, the collapsible dogs eventually release from the primary piston, allowing it to now move in the first direction with the applied pressure from the mandrel's bore. A gage ring body disposed on the upper end of the primary piston and adjacent the packing element then moves with the released primary piston so it can compress the packing element against a fixed gage ring.

In either implementation of the delay, the set packer is removable by first separating the mandrel into first and second portions at a location disposed between the first and second wedge units. Operators pull up on the upper mandrel portion using a retrieval tool, and movement of the upper portion releases the compression of the packing element. This movement also engages shoulders on the slip member against the wedge units so that the slip member and wedge units can hold the first and second mandrel portions together. Pulling up further on the upper portion causes the slip assembly to recede away from the casing and moves the gage rings further away from the packing element so the packer can be retrieved from downhole.

As can be seen in the disclosed packer, the slips are set first before the packing element is compressed. In this way, no substantial forces are transmitted through the packing element while the slips are being set. This form of activation combined with having the hydraulic activation mechanism disposed below the packing element and slips makes the packer more modular so that intervention less setting devices (i.e., atmospheric chambers) can be disposed further downhole. In addition, the disclosed packer does not use an element mandrel for a packing element that has an O-ring seal and slides on a main mandrel, as is done for some retrievable packers in the art and is prone to leaking.

The foregoing summary is not intended to summarize each potential embodiment or every aspect of the present disclosure.

DETAILED DESCRIPTION

Figure 1A:
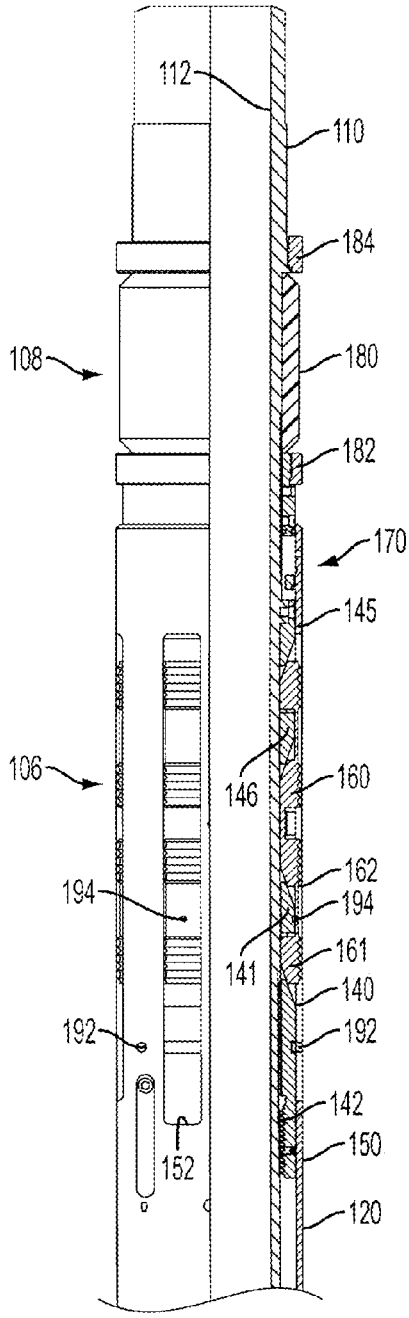
FIGS. 1A-1C illustrate a removable packer according to the present disclosure in a run-in condition.
Figure 1B:
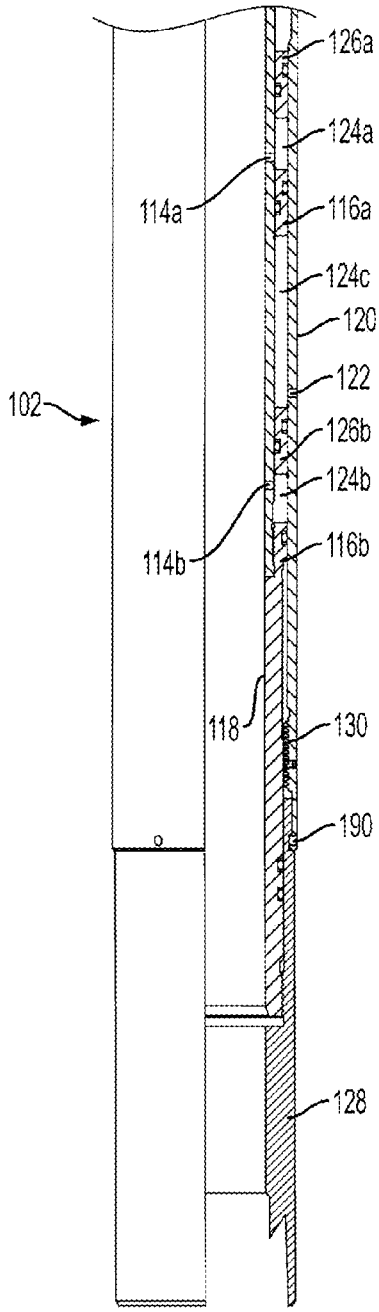

A hydraulic-set packer 100 disclosed herein has a configuration different from what is typically used in the art. As shown in FIG. 1A-1B, for example, the packer 100 has a packing assembly 108 toward the uphole end, a hydraulic piston assembly 102 toward the downhole end, and a slip assembly 106 disposed on the packer 100 between them. As noted previously, the typical configuration uses a packing element uphole, slips downhole, and a hydraulic piston disposed between them or uses slips uphole, a hydraulic chamber downhole, and a packing element disposed between them.

Although different in configuration, the disclosed packer 100 solves issues with mandrel movement during setting while advantageously having the packer's mechanics protected downhole by the packing assembly 108. For example, the packer 100 has its hydraulic piston assembly 102 disposed on the downhole end of the packer 100, which makes the packer 100 more modular for attaching accessories downhole to the packer 100. Therefore, accessories such as setting units can be attached downhole from the packer 100. In addition, the slip assembly 106 is disposed downhole from the packing assembly 108, which helps protect the slip assembly 106 from debris and scale and facilitates retrieving and removing the packer 100 from a wellbore.

As described in more detail below, the mandrel 110 of the packer 100 does not move during setting of the packer 100, and the packing element 108 preferably experiences little to no stress (i.e., compression) while the slip assembly 106 is set against the surrounding wall of a casing or the like. Therefore, the packer 100 delays compression of the packing assembly 108 by the piston assembly 102 until after the piston assembly 102 has set the slip assembly 106. Two arrangements of the packer 100 are discussed below.

A. Removable Hydraulic-Set Packer Having First Delay Arrangement

Figure 1C:
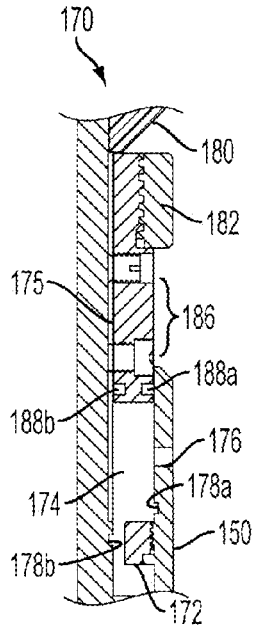

The removable packer 100 in FIGS. 1A-1C sets its slip assembly 106 separately from setting its packing assembly 106 using a first delay arrangement. In addition, the packer's hydraulic piston assembly 102 used to actuate the slip assembly 106 and the packing assembly 108 is positioned downhole on the packer 100 from the slip assembly 160. In this way, the setting force for the slip assembly 106 is not exerted through the packing assembly 108.

The packer 100 has a packer mandrel 110 with a lower sub 118 and a tailpipe 128 coupled thereto. The hydraulic piston assembly 102, the slip assembly 106, and the packing assembly 108 are disposed about the mandrel 110 and are operable to set the packer 100 downhole in a tubular, casing, or the like.

As shown in FIG. 1B, the hydraulic piston assembly 102 has a piston housing 120 disposed about the packer mandrel 110. This piston housing 120 incorporates a body lock ring 130 that can ratchet along a serrated surface on the lower sub 128 screwed onto the bottom of the packer mandrel 110. The space between the piston housing 120 and the packer mandrel 110 defines various chambers 124*a*-124*b* separated by alternating seals 116*a*-126*a* and 116*b*-126*b*. Ports 114*a*-114*b* communicate these chambers 124*a*-124*b* with the packer mandrel's internal bore 112 so that pressure communicated in the bore 112 can fill these chambers 124*a*-124*b* and move the piston housing 120 along the mandrel 110. An additional chamber 124*c* between the housing 120 and the mandrel 110 exhausts through a port 122 to the surrounding annulus when the piston housing 120 is moved.

Uphole on the packer 100 from the piston assembly 102, the slip assembly 106 as shown in FIG. 1A has a lower multi-wedge unit 140 and an upper multi-wedge unit 145 disposed about the mandrel 110. The lower multi-wedge unit 140 incorporates a body lock ring 142 that can ratchet along a serrated surface of the packer mandrel 110. A slip housing 150 holds multi-wedge slips 160 adjacent the multi-wedge units 140/145. The slip housing 150 connects to (or is part of) the piston housing 120 and has elongated slip windows 152 through which the slips 160 position and move. As shown, each side of the packer 100 can have two adjacent slips 160 so eight slips 160 can be positioned around the packer's circumference.

Uphole from the slip assembly 106, the packing assembly 108 has a delay mechanism 170 (shown in detail in FIG. 1C). In addition, the packing assembly 108 has a packing element 180 disposed between lower and upper gage rings 182 and 184. Further details of the components of the packer 100 are discussed below with reference to setting and retrieval procedures of the packer 100.

1. Setting the Removable Packer

Given the outline of the components of the packer 100 above, discussion now turns to how the removable packer 100 is run-in and set downhole. The packer 100 shown in FIGS. 1A-1B has a run-in condition in which the packing element 180 remains uncompressed and the piston assembly 102 and the slip assembly 106 remain inactivated. Once the packer 100 is lowered to a desired position downhole in a casing or the like (not shown), operators apply fluid pressure down the mandrel's bore 112.

Figure 2A:
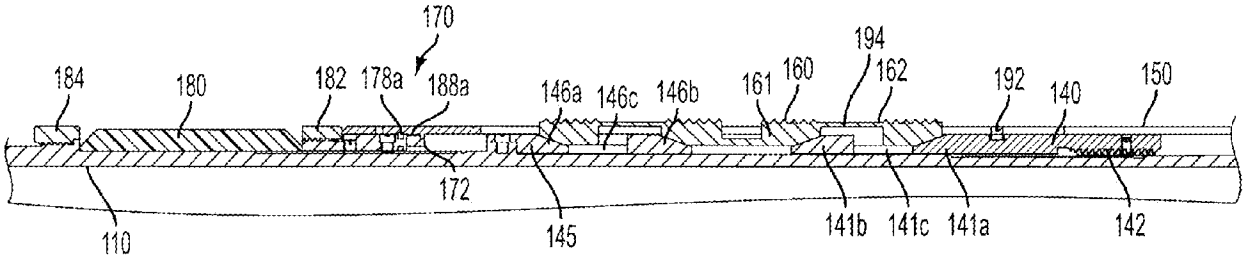
FIGS. 2A-2B illustrate the removable packer with the slips set.
Figure 2B:
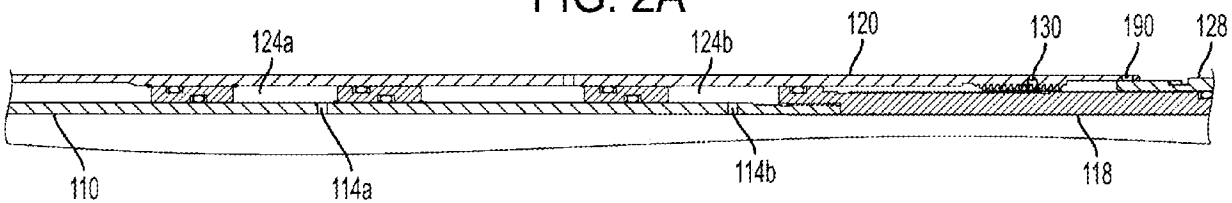

Once a predetermined applied pressure is reached and as shown in FIG. 2B, the hydraulic piston housing 120 detaches from the tailpipe 128 by breaking shear screws 190. In one implementation, a 60-bar tubing pressure may be enough to fully set the slips 160, and the piston housing 120 can be set to shear away after a 100-bar tubing pressure is reached. Of course, these values can vary for a given implementation. The freed housing 120 then moves upwards as pressure fills chambers 124*a*-124*b* via ports 114*a*-114*b*.

As shown in FIG. 2A, the lower multi-wedge unit 140 affixes to the piston housing 120 via shear screws 192, and each slip 160 affixes with a shear screw 194 to the lower multi-wedge unit 140. As shown, the lower unit 140 has an outer wedge 141*a* connected to an inner wedge 141*b* and separated by a gap 141*c*. Likewise, the upper unit 145 has an outer wedge 146*a* connected to an inner wedge 146*b* and separated by a gap 146*c*. Mimicking the multi-wedge units 140/145, the slip 160 has opposing ends connected together in the center. Each opposing end has slip wedges 161 separated by a wicker 162. The slip wedges 161 engage the unit wedges 141/146 depending on how the units 140/145 are positioned relative to one another.

During the movement of the piston housing 120, the lower multi-wedge unit 140 and the slips 160 move upward. During this action, the slips 160 ride up the upper multi-wedge unit 145 until the slips 160 contact the surrounding casing (not shown) and release from the lower multi-wedge unit 140 via breaking of the shear screws 194. Consequently, with further upward movement, the lower multi-wedge unit 140 moves under the slips 160 until the slips 160 bite along their entire length into the surrounding casing. In addition, as the piston housing 120 moves, the body lock ring 142 underneath the lower multi-wedge unit 140 ratchets on the packer mandrel 110 and holds the slip 160 extended out to the surrounding casing.

As shown in FIG. 2A, continued upward movement fully sets the slips 160. As of yet, however, the packing element 180 has not been subjected to any loads during the setting of the slips 160. Eventually, the slip housing 150 contacts the lower gage ring 182 via the delay mechanism 170. In particular and referring to the detail in FIG. 1C, the delay mechanism 170 between the lower gage ring 182 and slip housing 150 has a shoulder 172 disposed on the inside of the slip housing 150 within a chamber 174 defined between the gage ring 182 and portion of the mandrel 110. As the slip housing 150 is moved upward, the fluid trapped in the chamber 174 escapes through a port 176. Eventually, the shoulder 172 engages the gage ring 182. An outer snap ring 188*a* on the gage ring 182 engages in an inner slot 178*a* on the housing 150 to lock them together. As the housing 150 continues to move, force of the shoulder 172 against the gage ring 182 moves the shear screws 186 connected to the gage ring 182 in rat holes or slots 175 defined in the mandrel 110 to guide the gage rings 182 movement.

Figure 3A:
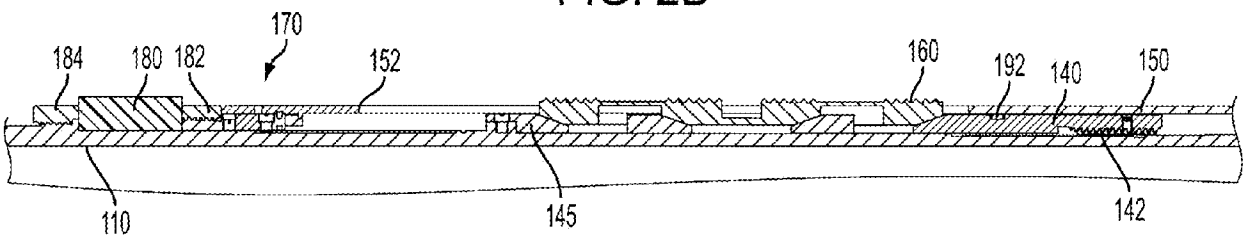
FIGS. 3A-3B illustrate the removable packer with the packing element compressed.
Figure 3B:
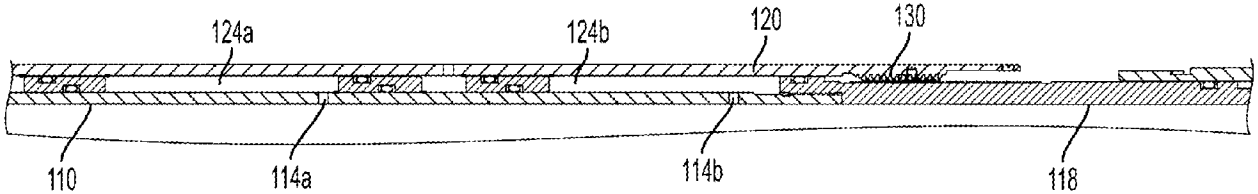

The packer 100 at this point in FIG. 2A has reached a particular extent in its setting operation. The setting of the slips 160 acts against the movement of the lower multi-wedge unit 140 by the piston housing 120, and the engagement of the shoulder 172 with the lower gage ring 182 acts against the movement the piston housing 120. At an applied pressure defined by the shear screws 192, the slip housing 150 detaches from the lower multi-wedge unit 140 by breaking of the shear screws 192. The break of the temporary connection may be designed to occur before, during, or slightly after the point when the shoulder 172 of the housing 150 engages the lower gage ring 182. Once the slip housing 150 detaches as shown in FIG. 3A, however, the elongated slip windows 152 of the slip housing 150 allow further upward movement, and continued movement compresses the packing element 180 between the gage rings 182/184. Once the packing element 180 is compressed and fully packed off, it is kept in compression by the body lock ring 130 between the piston housing 120 and the tailpipe 128, which holds the slip housing 150 in its engaged position as shown in FIG. 3B.

2. Retrieving the Removable Packer

Figure 4A:
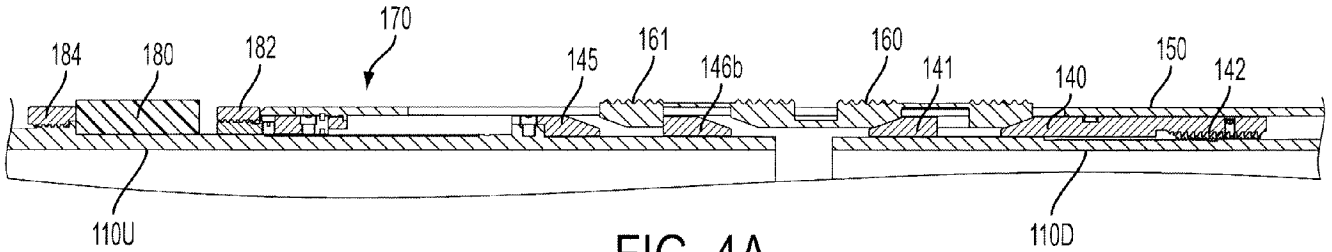
FIGS. 4A-4B illustrate the removable packer with the mandrel cut.
Figure 4B:
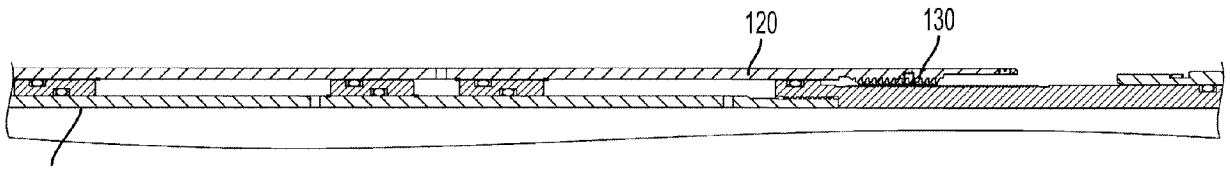
Figure 5A:
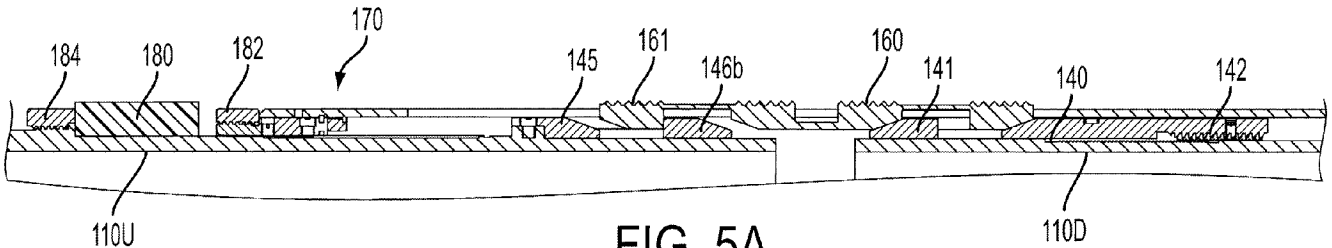
FIGS. 5A-5B illustrate the removable packer with the slips initially pulled.
Figure 5B:
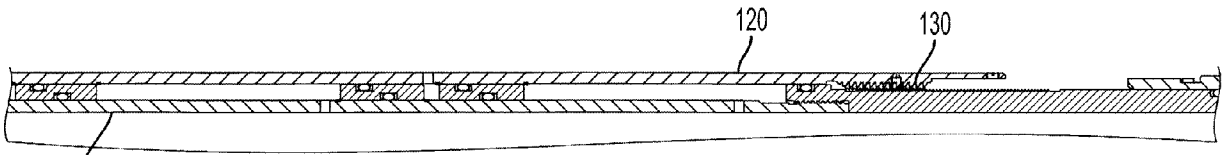
Figure 6A:
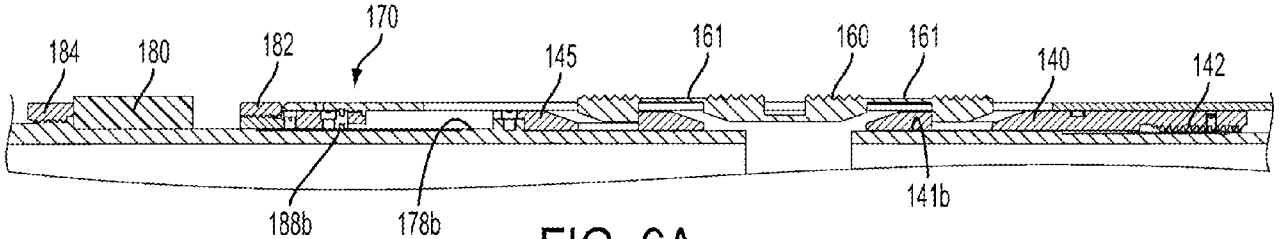
FIGS. 6A-6B illustrate the removable packer with the slips fully pulled.
Figure 6B:
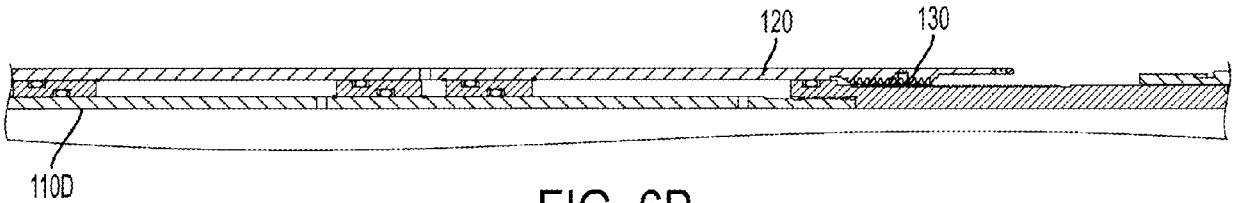

Retrieval of the packer 100 once set is discussed below with reference to FIGS. 4A through 7B. To initiate retrieval, the packer mandrel 110 is cut between the upper multi-wedge unit 145 and the body lock ring 142 of the lower multi-wedge unit 140 as shown in FIG. 4A. This can be accomplished using a motorized cutting tool, such as the MCT available from Weatherford—the assignee of the present disclosure. Alternatively, other devices or techniques known in the art can be used to cut the mandrel 110, such as chemical techniques or radial cutting torches.

An appropriate retrieval tool (not shown) engages the packer 100's uphole end to pull up on the uphole mandrel portion 110U. As the retrieval tool picks up on this portion 110U (i.e., applies tension), back shoulders on the inner wedges 146*b* of the upper multi-wedge unit 145 catches on the outer slip wedges 161 of the slips 160 and pulls up on the slips 160 (See FIGS. 4A and 5A). With further upward movement, the slips 160 are pulled away from the lower multi-wedge unit 140 until the lower end of the slips 160 catch on the lower multi-wedge unit 140 (See FIG. 6A). As shown, the wickers 162 of the slips 160 are flat where they pass over the multi-wedge units 140/145 to ease releasing of the slips 160.

Figure 7A:
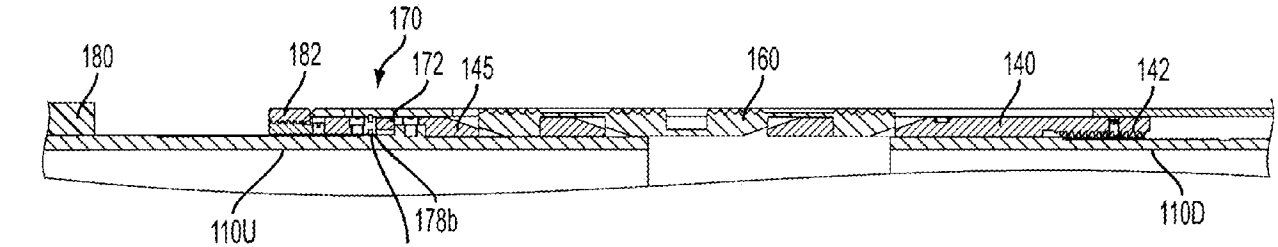
FIGS. 7A-7B illustrate the removable packer in the fully stroked condition for removal.
Figure 7B:
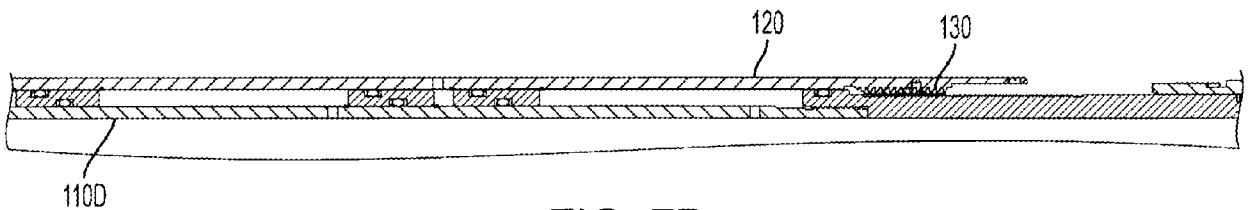

Finally, upward movement continues until the upper multi-wedge unit 145 engages the shoulder 172 and lower gage ring 182 (See FIG. 7A). An inner snap ring 188*b* on the lower gage ring 182 locks into an outer slot 178*b* on the mandrel 110 (See also FIG. 1C) so the packer 100 is fully stroked and cannot be set by downward movement. Any further pick up load on the packer 100 by the retrieval tool transfers through the slip housing 150, to the piston housing 120, to the lower sub 118, and to the tailpipe 128 hanging underneath the packer 100 so the packer 100 can be retrieved (See FIGS. 7A-7B).

B. Removable Hydraulic-Set Packer Having Second Delay Arrangement

Figure 8A:
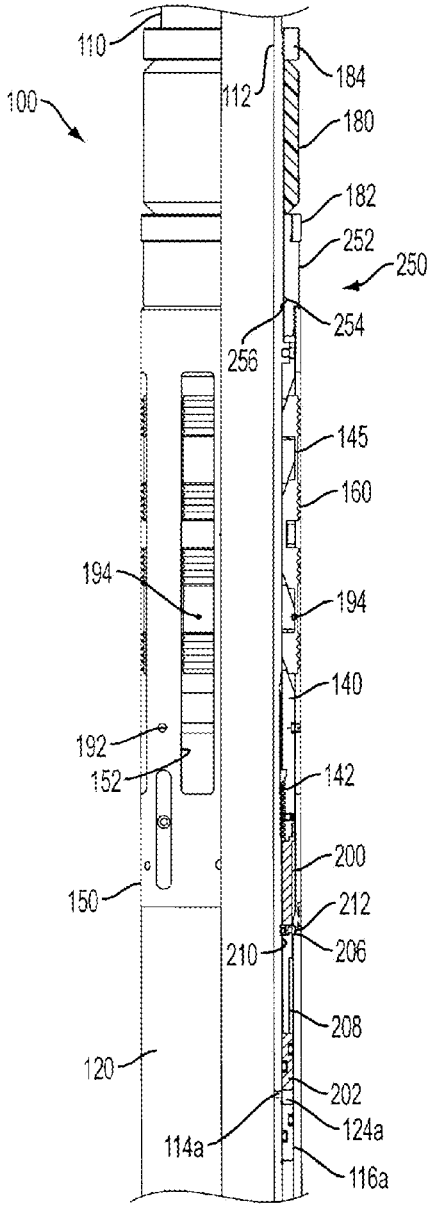
FIGS. 8A-8D illustrate another removable packer according to the present disclosure in a run-in condition.
Figure 8B:
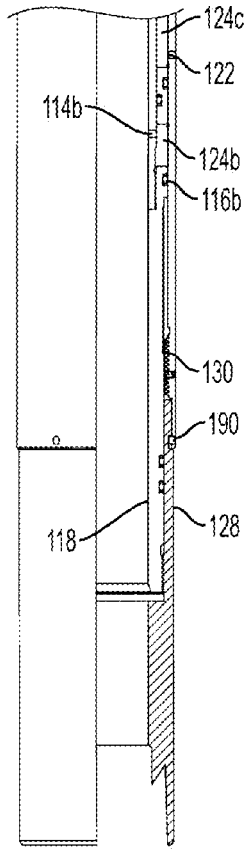

Another arrangement of the removable packer 100 shown in FIGS. 8A-8B has similar components to the previously described packer. Therefore, similar components have the same reference numerals, and operation of some of the packer's features are not repeated here for brevity. In contrast to the previous packer, however, the packer 100 of FIGS. 8A-8B has an intermediate or secondary piston 200 and has a gage and snap ring arrangement 250 near the packing element 180, which are different from the previous packer. The intermediate piston 200 (shown in isolated partial cross-section in FIG. 8C) delays the compression of the packing element 180 until after the point when fluid pressure has successfully set the slips 160 against the surrounding casing. The gage and snap ring arrangement 250 near the packing element 180 helps fix the packer 110 when being retrieved.

Figure 8C:
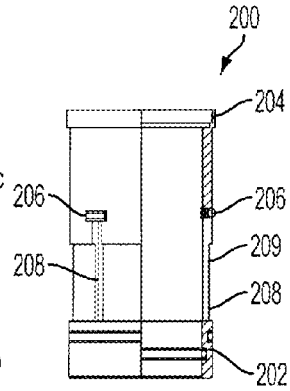
Figure 8D:
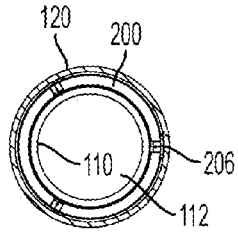

As shown in FIG. 8D, the intermediate or secondary piston 200 is operably separate from the primary piston composed of the piston housing 120 and other related components. As shown in FIG. 8C, the intermediate piston 200 has a lower end 202 with seals and has an upper end 204 with an internal thread. As shown in FIG. 8A, the lower end 202 fits in the annulus between the piston housing 120 and the mandrel 110, and fluid pressure entering through a port 114*a* into a chamber 124*a* acts against the lower end 202 to push the intermediate piston 200 towards the uphole end of the packer 100. As also shown in FIG. 8A, the upper end 204 threads onto the lower multi-wedge unit 140 so that the intermediate piston 200 and unit 140 travel together along the mandrel 110 when pressure pushes the piston 200.

As also shown in FIG. 8C, the intermediate piston 200 also has a channel 208 in which a collapsible dog 206 can travel. Three such channels 208 and dogs 206 are provided around the circumference of the piston 200 as best shown in FIG. 8D. When the piston 200 moves, the dogs 206 can travel in the channels 208, essentially remaining stationary as the piston 200 moves, as described in more detail below. At a lower extent of the channels 208 near the lower end 202 of the piston 202, the circumference of the piston 202 decreases to form a recess 209 that provides a space in which the collapsible dogs 206 can retract, as will be described in more detail below.

For its part, the gage and snap ring arrangement 250 as shown in FIG. 8A has a gage ring body 252 coupled to the upper end of the slip housing 150, which in the present arrangement threadably connects to the piston housing 120 near the intermediate piston 200 to facilitate assembly. The gage ring body 252 has the lower gage ring 182 disposed thereon and essentially forms part of the gage ring for compressing the packing element 180 on the mandrel 110. A snap ring 254 on the inside of the body 252 is movable relative to a slot 256 defined on the outside of the mandrel 110. As described in more detail later, the snap ring 254 can engage in the slot 256 to lock the body 252 to the mandrel 110 when retrieving the packer 100.

1. Setting the Removable Packer

Turning first to the setting procedure, the removable packer 100 is shown in its run-in condition in FIGS. 8A-8B. The intermediate piston 200 with collapsible dogs 206 locks the housings 120/150 relative to the packer mandrel 110. In particular, the dogs 206 engage an outer slot 210 in the mandrel 110 and engage an inner slot 212 in the piston housing 120. Engaged in these slots 210/212, the dogs 206 lock the housings 120/150 relative to the mandrel 110.

Figure 9:
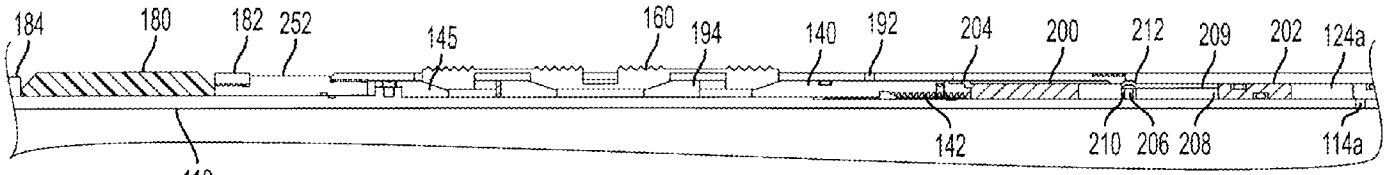
FIG. 9 illustrates the removable packer with the slips set.

Operators pump fluid through the mandrel's bore 112 to activate the packer 100. As shown in FIG. 9, fluid pressure enters the chamber 124*a* through the port 114*a* and acts against the lower end 202 of the intermediate piston 200. The acting pressure causes the piston 200 to move relative to the mandrel 110 and piston housing 120 and causes it to push the lower multi-wedge unit 140 upward. Meanwhile, as the piston 200 moves, the collapsible dogs 206 are allowed to move in the channels 208 of the piston 200. In this way, the piston 200 can force the lower multi-wedge unit 140, break the shear pins 192/194, and move the wedge unit 140 an extent to set the slips 160 as fluid pressure builds while the dogs 206 lock the housings 120/150 relative to the mandrel 110.

During movement of the wedge unit 140, the slips 160 ride up the upper multi-wedge unit 145 until they release from the lower multi-wedge 140 via the shear screws 194 and contact the surrounding casing. Further upward stroke of the intermediate piston 200 allows the lower wedge unit 140 to move under the slips 160 until the slips 160 bite in their entire length into the casing. All the while, however, the piston housing 120 and connected slip housing 150 do not move and do not begin compressing the compressible packing element 180 because the piston housing 120 is locked relative to the mandrel 110 by the engaged dogs 206.

Eventually, as shown in FIG. 9, however, the piston 200 moves to an extent where the collapsible dogs 206 reach the recess 209 of the piston 200. This allows the dogs 206 to collapse as the smaller circumference of the piston 200 at the recess 209 slides under the dogs 206 and leaves the dogs 206 unsupported. As a result, the dogs 206 disengage from the inner slot 212 defined in the piston housing 120, freeing the piston housing 120 to move relative to the mandrel 110. Each end of the dogs 206 can be shear pinned to each other if higher pack-off forces are needed.

Figure 10:
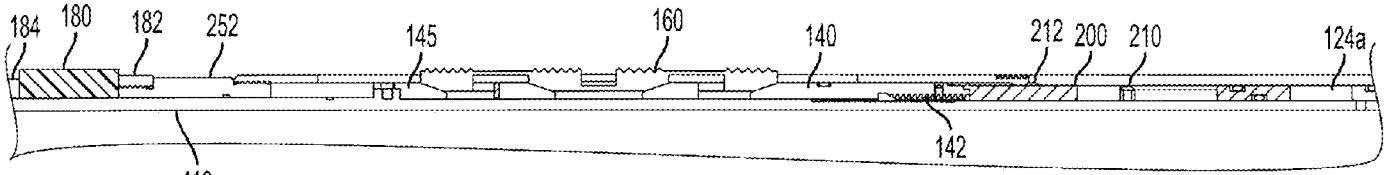
FIG. 10 illustrates the removable packer with the packing element compressed.

At this point when the slips 160 are set and the dogs 206 are retracted, fluid pressure acting in the chamber 124*b* through the port 114*b* forces the housings 120/150 to shear from the tailpipe 128 via shear pins 190 (See FIG. 8B). Freed from the mandrel 128, the piston housing 120 moves upwards and likewise moves the slip housing 150 coupled thereto. As shown in FIG. 10, the moving housings 120/150 force the upper body 252 and coupled gage ring 182 against the packing element 180 and compresses the element 180 against the upper gage ring 184 so that the packer 100 is fully set.

2. Retrieving the Removable Packer

Figure 11:
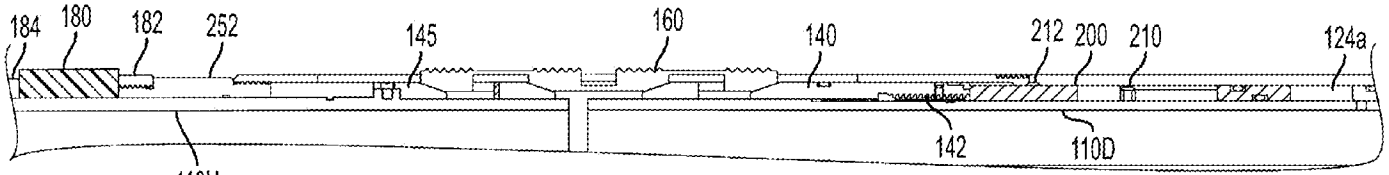
FIG. 11 illustrates the removable packer with the mandrel cut.
Figure 12:
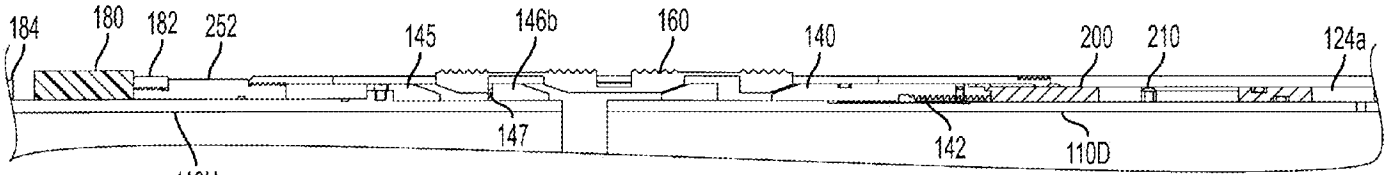
FIG. 12 illustrates the removable packer in an initial pick-up condition.
Figure 13:
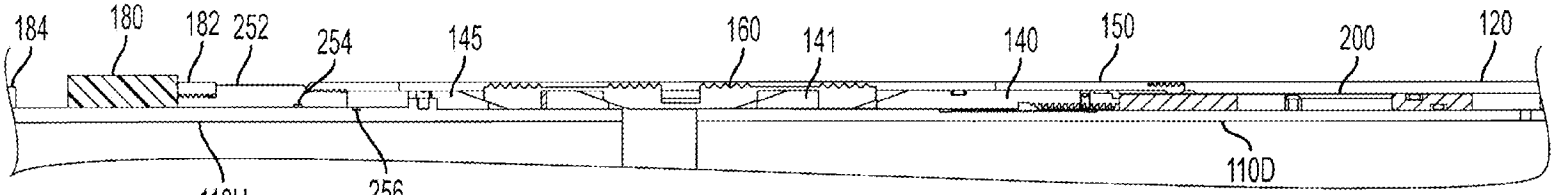
FIG. 13 illustrates the removable packer in a subsequent pick-up condition.
Figure 14:
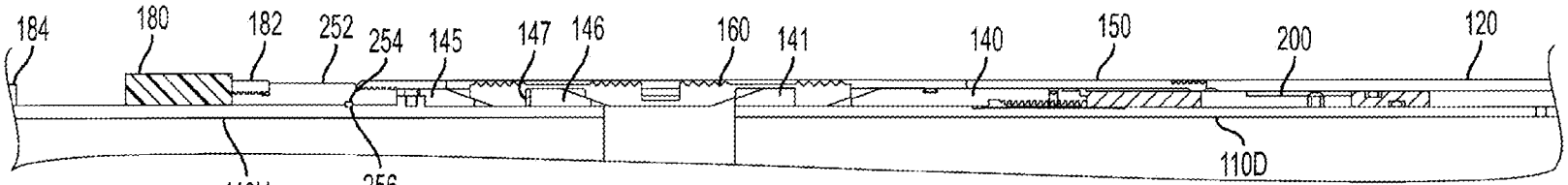
FIG. 14 illustrates the removable packer in a further pick-up condition.

Retrieval of this packer 100 is similar to that discussed previously. As shown in FIG. 11, the packer mandrel 100 is cut between the upper multi-wedge unit 145 and the body lock ring 142 using tools and techniques known in the art. Operators then pick-up on the uphole mandrel portion 110U using a retrieval tool (not shown). This moves the upper multi-wedge unit 145 away from the slips 160. Eventually as shown in FIG. 12, back plates 147 on the inner wedges 146*b* of the unit 145 catches the slips 160 and pulls them up as well. With further upward movement of the uphole mandrel portion 110U, the upper multi-wedge unit 145 pulls the slips 160 away from the lower multi-wedge 140. (See FIG. 13). Finally, the upper multi-wedge unit 145 engages the body 252 having lower gage ring 182. (See FIG. 14). The packer 100 is now fully stroked and cannot be set by downward movement because the snap ring 254 in the gage ring body 252 locks in the slot 256 in the uphole mandrel portion 110U.

Figure 15:
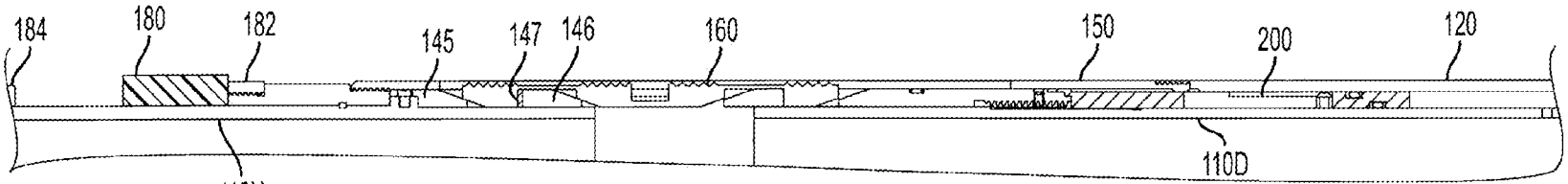
FIG. 15 illustrates the removable packer in the fully stroked condition for removal.

As shown in FIG. 15, further pick-up of the upper mandrel portion 110U pulls the lower multi-wedge unit 140 further along the ratchet mechanism 130 until the dogs 206 reach the lower end 202 of the intermediate piston 200. Further pick-up also transfers through the slip housing 150 to the hydraulic piston housing 120, the bottom sub 118, and to the tailpipe 128 hanging underneath the packer 100 so that the packer 100 can be retrieved from the casing.

C. Boost Mechanism

Figure 16A:
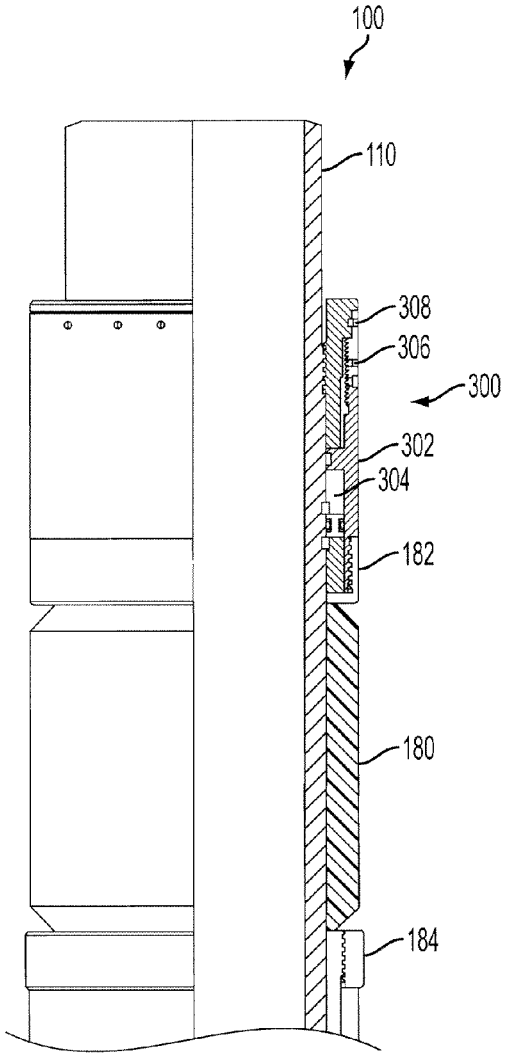
FIGS. 16A-16B illustrate boost mechanisms for the removable packer.

As an added feature, the disclosed packers 100 can have a boost mechanism should high pressure from the annulus require additional compression of the packing element. Different types of boost mechanisms could be used. For example, FIG. 16A shows a boost mechanism 300 having a piston 302. One end of the piston 302 attaches to the upper gage ring 182, while the other end affixes to the mandrel 110 by shear pins 308. The piston 302 encloses a sealed boost chamber 304, and a ratchet mechanism 306 locks movement of the piston 302 toward the packing element 180.

Sometimes during operation, the pressure in the annulus can exceed the pressure in the mandrel 110 to such an extent that reverse ballooning occurs. In this situation, the tubing coupled to the mandrel 110 attempts to collapse and begins to lengthen due to the compressive forces of the surrounding pressure in the annulus. As this occurs, the packing element 180 can loosen from its set condition, compromising its seal with the casing. In addition, the compressive forces from the surrounding pressure in the annulus can act directly against the packing element 180, compromising its seal.

The boost mechanism 300 counteracts these changes by applying additional compressive force against the packing element 300 to further expand it outward toward the surrounding casing. At a certain pressure differential between the annulus and tubing when reverse ballooning may occur, the boost piston 302 is forced downward by the decreasing volume in the chamber 304 and shears free of the shear pins 308. In turn, the freed piston 308 compresses against the packing element 180, as the boost chamber 304 decreases in volume from the surrounding higher pressure. The body lock ring 306 locks this movement of the boost piton 304 so that the additional compression of the packing element 180 can be maintained.

Figure 16B:
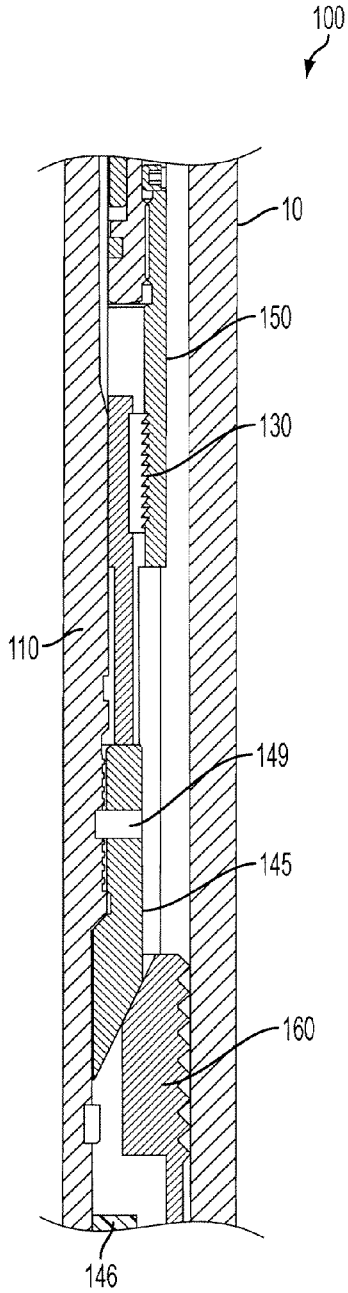

Another arrangement to achieve boost is shown in FIG. 16B. A portion of the packer 100 is shown with a side of the mandrel 110 adjacent a surrounding casing 10. In this arrangement, the main body lock ring 130 is positioned between the upper wedge unit 145 and the slip housing 150. Shear pins 149 with a high shear value affix the upper wedge unit 145 to the mandrel 110. These pins 149 only shear when reverse ballooning occurs in the annulus above the packer element (180).

At a certain pressure differential between the annulus and tubing pressure when reverse ballooning occurs, the tubing connected to the packer 100 tends to stretch, affecting the packing element (180). Eventually, the reverse ballooning causes the shear pins 149 between the mandrel 110 and the upper wedge unit 145 to shear. When this occurs, the freed packer mandrel 110 can then move downwards through the upper wedge unit 145.

Although not shown in FIG. 16B but as detailed elsewhere, the mandrel 110 has the lower wedge unit (140) and lock ring (142) disposed down further on the packer 100. Likewise, the mandrel 110 has the upper gage ring (184) affixed on the mandrel 110 next to the packing element (180) disposed up further on the packer 100. With the mandrel 110 free to move when reverse ballooning stretches the tubing above the packer 100, the mandrel 110 moves the upper gage ring (184) downhole to further compress the packing element (180). In addition, the mandrel 110 moves through the lower wedge unit (140) further down on the packer 100 so the lock ring (142) of this unit (140) can lock the downward movement of the mandrel 110 and maintain the additional compression of the packing element (180).

The foregoing description of preferred and other embodiments is not intended to limit or restrict the scope or applicability of the inventive concepts conceived of by the Applicants. Although not shown in FIGS. 1A-1C, for example, the packer 100 can have a sequential release slip as shown in the packer 100 of FIGS. 8A-8B. In addition, the intermediate piston 200 of FIG. 8C can be integrally connected with the lower multi-wedge unit 140 rather than threaded thereon, although this facilitates assembly. These and other modifications can be made with the benefit of the present disclosure.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A removable packer, comprising:

a mandrel having an internal bore;

a piston disposed on the mandrel and being movable in a first direction on the mandrel in response to pressure in the internal bore;

at least one slip disposed on the mandrel adjacent the piston, the least one slip being movable outward from the mandrel in response to the movement of the piston only up to a first threshold; and a packing element disposed on the mandrel adjacent the at least one slip, the packing element being compressible in response to the movement of the piston only beyond the first threshold and after the movement of the at least one slip outward from the mandrel.

2. The packer of claim 1, wherein the piston comprises a piston housing being movable in the first direction on the mandrel.

3. The packer of claim 2, wherein the piston housing defines at least one window, the at least one slip disposed between the mandrel and the piston housing and being movable outward from the mandrel through the at least one window.

4. The packer of claim 2, wherein the mandrel defines at least one port communicating the internal bore of the mandrel with at least one space between the piston housing and the mandrel, and wherein the pressure in the internal bore passes through the at least one port and into the at least one space and acts against a portion of the piston housing.

5. The packer of claim 1, wherein the at least one slip comprises:

a first wedge unit disposed adjacent the mandrel and being temporarily connected to the piston, the first wedge unit being movable with the piston up to the first threshold defined by the temporary connection between the first wedge unit and the piston;

a second wedge unit disposed on the mandrel and opposing the first wedge unit; and a slip member disposed between the first and second wedge units and being movable outward from the mandrel by the movement of the first wedge unit toward the second wedge unit.

6. The packer of claim 5, wherein the first and second wedge units each comprise first and second wedges separated by a gap, and wherein the slip member has first and second ends, each of the first and second ends having third and fourth wedges separated by a wicker, the third and fourth wedges of the first end engageable with the first and second wedges of the first wedge unit, the third and fourth wedges of the second end engageable with the first and second wedges of the second wedge unit.

7. The packer of claim 5, wherein the first wedge unit comprises a ratchet mechanism engageable with the mandrel and preventing movement of the first wedge unit in a second direction opposite to the first direction.

8. The packer of claim 5, wherein the slip member is temporarily connected to the first wedge unit and is breakable therefrom in response to a second threshold, the second threshold being less than the first threshold.

9. The packer of claim 1, wherein the piston comprises a ratchet mechanism engageable with the mandrel and preventing movement of the piston in a second direction opposite to the first direction.

10. The packer of claim 1, wherein the packing element is disposed between first and second gage rings disposed on the mandrel, the first gage ring movable on the mandrel in response to the movement of the piston beyond the first threshold, the second gage ring being affixed to the mandrel.

11. The packer of claim 10, wherein the piston defines a shoulder contactable with the first gage ring.

12. The packer of claim 10, wherein the piston defines a slot engageable with a snap ring on the first gage ring.

13. The packer of claim 1, wherein the at least one slip comprises:

a first wedge unit disposed adjacent the mandrel and being movable with the piston; and a second wedge unit disposed on the mandrel and opposing the first wedge unit, and a slip member disposed between the first and second wedge units and being movable outward from the mandrel by the movement of the first wedge unit toward the second wedge unit; and wherein the mandrel is separable into first and second mandrel portions at a location disposed between the first and second wedge units, the first wedge unit disposed adjacent the first mandrel portion, the second wedge unit disposed adjacent the second mandrel portion.

14. The packer of claim 13, wherein the slip member has a first shoulder engageable in the first direction with the first wedge unit and has a second shoulder engageable in a second direction with the second wedge unit, the first and second shoulders engaged with the first and second wedge units holding the first and second mandrel portions together.

15. The packer of claim 14, wherein the piston is affixable to a gage ring adjacent the packing element when the piston is moved in the first direction, and wherein the gage ring is affixable to the second mandrel portion when moved in the second direction relative thereto.

16. The packer of claim 13, wherein the piston defines a first slot engageable with a first snap ring on the gage ring when the piston is moved in the first direction, and wherein a second snap ring engages in a second slot in the second mandrel portion when the piston is moved in the second direction relative thereto.

17. The packer of claim 1, wherein in response to the movement of the piston up to the first threshold, the at least one slip is moved outward and the packing element is not compressed; and wherein in response to the movement of the piston beyond the first threshold, the packing element is compressed and the at least one slip is not moved outward.

18. A removable packer, comprising:

a mandrel having an internal bore;

a piston disposed on the mandrel and being movable in a first direction on the mandrel in response to pressure in the internal bore, wherein the piston comprises:

a first piston member temporarily coupled to the mandrel and being movable in the first direction on the mandrel in response to the pressure in the internal bore;

a second piston member being movable in the first direction in response to the pressure in the internal bore, the movement of the second piston member moving the least one slip outward from the mandrel; and at least one dog temporarily coupling the first piston member to the mandrel and being movable relative to the second piston member, the at least one dog releasable from the first piston member after the at least one dog has moved a first distance relative to the second piston member;

at least one slip disposed on the mandrel adjacent the piston, the least one slip being movable outward from the mandrel in response to the movement of the piston up to a first threshold; and a packing element disposed on the mandrel adjacent the at least one slip, the packing element being compressible in response to the movement of the piston beyond the first threshold and after the movement of the at least one slip outward from the mandrel.

19. The packer of claim 18, wherein the at least one dog is movably disposed in a channel defined in the first direction along the second piston member, and wherein the at least one dog is releasably engageable in a first slot in the first piston member and is engaged in a second slot in the mandrel.

20. The packer of claim 19, wherein the second piston member defines a recess along a portion of the channel, wherein the at least one dog moved in the channel disengages from first slot in the first piston member when reaching the recess along the portion of the channel.

21. The packer of claim 18, wherein the first piston member comprises a gage ring body disposed adjacent the packing element, the gage ring body movable by the first piston member when released from the mandrel and compressing the packing element against a fixed gage ring disposed on the mandrel.

22. The packer of claim 18, wherein the at least one slip comprises:

a first wedge unit disposed adjacent the mandrel, the first wedge unit being temporarily connected to the first piston member and being fixedly connected to the second piston member, the first wedge unit being movable with the second piston member beyond the first threshold defined by the temporary connection;

a second wedge unit disposed on the mandrel and opposing the first wedge unit; and a slip member disposed between the first and second wedge units and being movable outward from the mandrel by the movement of the first wedge unit toward the second wedge unit.

23. The packer of claim 22, wherein the first wedge unit comprises a ratchet mechanism engageable with the mandrel and preventing movement of the first wedge unit in a second direction opposite to the first direction.

24. The packer of claim 22, wherein the slip member is temporarily connected to the first wedge unit and is breakable therefrom in response to a second threshold less than the first threshold.

25. The packer of claim 22, wherein the first and second wedge units each comprise first and second wedges separated by a gap, and wherein the slip member has first and second ends, each of the first and second ends having third and fourth wedges separated by a wicker, the third and fourth wedges of the first end engageable with the first and second wedges of the first wedge unit, the third and fourth wedges of the second end engageable with the first and second wedges of the second wedge unit.

26. The packer of claim 22, wherein the mandrel is separable into first and second mandrel portions at a location disposed between the first and second wedge units, the first wedge unit disposed adjacent the first mandrel portion, the second wedge unit disposed adjacent the second mandrel portion.

27. The packer of claim 26, wherein the slip member has a first shoulder engageable in the first direction with the first wedge unit and has a second shoulder engagable in a second direction with the second wedge unit, the first and second shoulders engaged with the first and second wedge units holding the first and second mandrel portions together.

28. The packer of claim 26, wherein the first piston member has a first shoulder engaging a second shoulder on the second portion mandrel in a second direction.

29. The packer of claim 18, wherein the first piston member comprises a ratchet mechanism engageable with the mandrel and preventing movement of the first piston in a second direction opposite to the first direction.

30. A removable packer, comprising:

a mandrel having an internal bore;

a piston disposed on the mandrel and being movable in a first direction on the mandrel in response to pressure in the internal bore;

a first wedge unit disposed adjacent the mandrel and being temporarily connected to the piston, the first wedge unit being movable with the piston only up to a first threshold of the temporary connection;

a second wedge unit disposed on the mandrel and opposing the first wedge unit;

a slip member disposed between the first and second wedge units and being movable outward from the mandrel by the movement of the first wedge unit in the first direction toward the second wedge unit only up to the first threshold; and a packing element disposed on the mandrel adjacent the second wedge unit, the packing element being compressible in response to the movement of the piston only beyond the first threshold and after the movement of the slip member outward from the mandrel.

31. A packer setting and retrieval method, comprising:

deploying a mandrel of the packer downhole;

applying pressure in the mandrel against a piston disposed on the mandrel;

moving the piston in a first direction on the mandrel;

moving at least one slip outward from the mandrel in response to movement of the piston only up to a first threshold in the first direction; and compressing a packing element on the mandrel in response to the movement of the piston only beyond the first threshold, the packing element being compressed after movement of the at least one slip outward from the mandrel.

32. The packer of claim 30, wherein in response to the movement of the piston up to the first threshold, the at least one slip is moved outward and the packing element is not compressed; and wherein in response to the movement of the piston beyond the first threshold, the packing element is compressed and the at least one slip is not moved outward.

* * * * *